United States Patent [19]

Pyle et al.

[11] Patent Number: 4,776,636

[45] Date of Patent: Oct. 11, 1988

[54] BUTTON FORMING ASSEMBLY

[75] Inventors: Godfrey J. Pyle, Shoreview, Minn.; O. B. Solie, Rockford, Ill.; Gerald L. Faulkner, Greensboro, N.C.

[73] Assignee: Minnesota Mining and Manufacturing Company, Saint Paul, Minn.

[21] Appl. No.: 926,372

[22] Filed: Oct. 31, 1986

[51] Int. Cl.[4] ..... A47C 31/02

[52] U.S. Cl. ..... 297/452; 5/472; 297/218; 297/219; 297/458

[58] Field of Search ..... 297/218, 219, 452, 458, 297/459; 5/471, 472

[56] References Cited

U.S. PATENT DOCUMENTS

| | | | |
|---|---|---|---|
| 765,377 | 7/1904 | Busche | 5/472 |
| 3,103,082 | 9/1963 | Baumann | 297/452 X |
| 3,266,066 | 8/1966 | Bereday | 297/452 X |
| 3,630,572 | 12/1971 | Homier | 5/471 X |
| 3,904,242 | 9/1975 | Koepke et al. | 297/458 X |
| 4,454,183 | 6/1984 | Wollman | 24/306 X |
| 4,514,869 | 5/1985 | Aoki et al. | 5/472 |
| 4,609,226 | 9/1986 | Yoshizawa | 297/452 |

FOREIGN PATENT DOCUMENTS

| | | | |
|---|---|---|---|
| 8986 | 3/1980 | European Pat. Off. | 5/472 |
| 1320876 | 2/1963 | France | 297/219 |

*Primary Examiner*—Kenneth J. Dorner
*Assistant Examiner*—Peter R. Brown
*Attorney, Agent, or Firm*—Donald M. Sell; William L. Huebsch

[57] ABSTRACT

A button forming assembly adapted for use in an upholstered cushion of the type comprising a backing, a flexible cover overlying the backing, and a layer of compressible padding material between the backing and the cover. The button forming assembly comprises a button forming member including a head portion in the shape of a button to be formed, and an attachment portion having a cross sectional area smaller than the cross sectional area of the head portion projecting from one side of the head portion. The cover is secured around the attachment portion with a part of the cover positioned smoothly around the head portion, and attachment means are engaged between the attachment portion and the backing through an opening in the padding material to retain the button forming member in place with the cover under tension and the padding partially compressed around the opening to shape the cushion.

11 Claims, 3 Drawing Sheets

BUTTON FORMING ASSEMBLY

TECHNICAL FIELD

The present invention relates to methods and structures for forming tufts on upholstered items, and the tufted items thus formed.

BACKGROUND ART

Prior art methods for forming tufts on upholstered items such as chairs, couches or footstools have typically included using buttons to which cords are attached, inserting the cords through a flexile cover and an underlying layer of compressible padding of the upholstered item from an outer surface of the cover as with a needle, and attaching the cords to a backing on the item with the cover under tension and the padding partially compressed. All too often the cover will subsequently tear around at least one of the openings through which the cords are inserted, allowing a button at the tear to pull through the cover, thereby blemishing the upholstered item in a way that is difficult to repair.

U.S. patent application No. 761,000 filed July 31, 1985, describes making tufts without buttons by engaging fastener portions attached on the inner side of the cover and the backing through openings in the padding. While such tufting is convenient to make and is aesthetically pleasing, the tufts do not have buttons showing on the outer surface of the covering which is inappropriate for some styles of furniture.

DISCLOSURE OF THE INVENTION

The present invention provides a button forming assembly for use in forming a tuft with a button at its center and a method for forming a tuft using the button forming assembly which is easy to preform and makes such a tuft without causing an opening at which a tear can start through a cover in which the tuft is formed.

According to the present invention there is provided a button forming assembly adapted for use in tufting an upholstered item, which button forming assembly includes a head portion in the shape of a button to be formed, and an attachment portion having a cross sectional area smaller than that of the head portion projecting from one side of the head portion. The button forming assembly is adapted to have a part of the cover positioned smoothly around the head portion and gathered around the attachment portion, and securing means are provided for securing the gathered cover part around the attachment portion. Also provided is attachment means adapted for engagement between the attachment portion and a backing through an opening in compressible padding between the cover and the backing to retain the button forming member in place relative to the backing and padding with the cover under tension and the padding partially compressed to shape the upholstered item.

The means for securing the gathered cover part around the attachment portion can be a metal ring, a length of plastic or fiber cord, or a similar securing member adapted to encircle the gathered cover part.

In one embodiment the attachment means comprises a fastener comprising a first fastener portion having a plurality of loops, and a second fastener portion having a plurality of barbed hooks adapted for engagement with the loops, with one of the fastener portions being adapted to be attached to the backing, and the other of the fastener portions being fixed to the attachment portion. In a preferred embodiment of this fastener, the loops and barbed hooks can be easily engaged by pressing them together, however, loops engaged with the barbed hooks must be broken to afford separation of the hooks from the loops, so that very strong attachment can easily be made.

Alternatively, the attachment means can comprise a length of cord or wire attaching the second fastener portion to the backing.

The button forming assembly can easily form buttons of various shapes including, for example, generally spherical, circular, rectangular, triangular, oval, hexagonal or rectangular shapes; and buttons having a plurality of projecting semispherical lobes around their peripheries, or having a generally diamond-like shape can also be made.

Preferably the method for forming a button in an upholstered item by using the button forming assembly comprises the steps of positioning a part of the cover around the head and attachment portions; securing the covering around the attachment portion to retain that part of the covering around the head and attachment portions; and attaching the attachment portion and the backing together through an opening in the compressible padding material to retain the button forming member in place relative to the backing and padding.

BRIEF DESCRIPTION OF THE DRAWING

The present invention will be further described with reference to the accompanying drawing wherein like numbers refer to like parts in the several views, and wherein.

DETAILED DESCRIPTION

Figure 1:
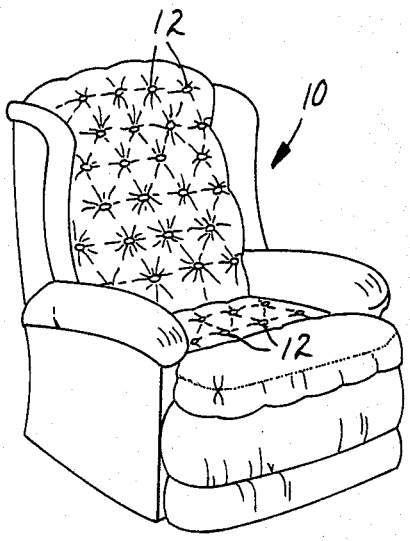
FIG. 1 is a perspective view of an upholstered chair tufted with button forming assemblies according to the present invention.

Referring now to the drawing there is shown an upholstered item or chair 10 according to the present invention having cushions with button tufts 12 along their outer surfaces.

Figure 2:
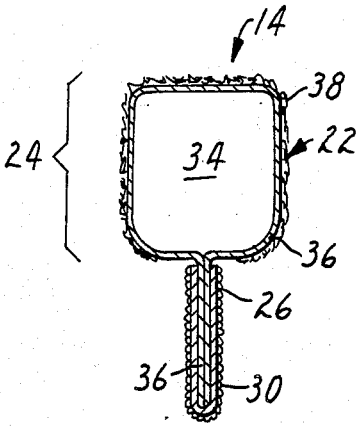
FIG. 2 is an side view of a first embodiment of a button forming assembly according to the present invention that could have been used to tuft the chair of FIG. 1.
Figure 4:
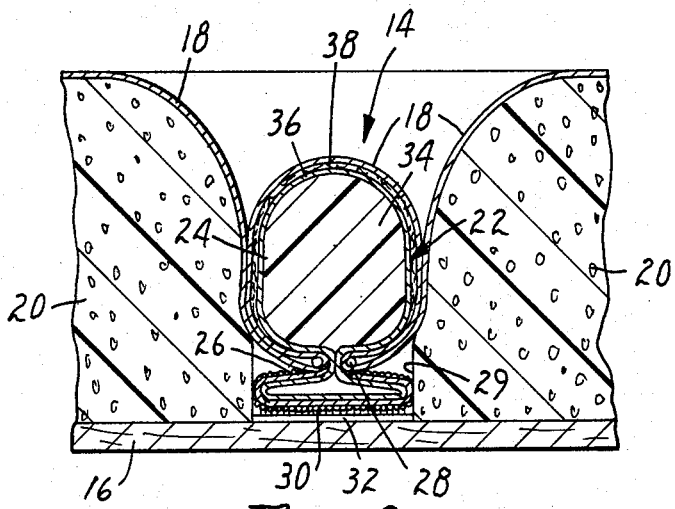
FIG. 4 is a view similar to FIG. 3 with the button forming assembly fully attached to tuft the upholstered item.
Figure 3:
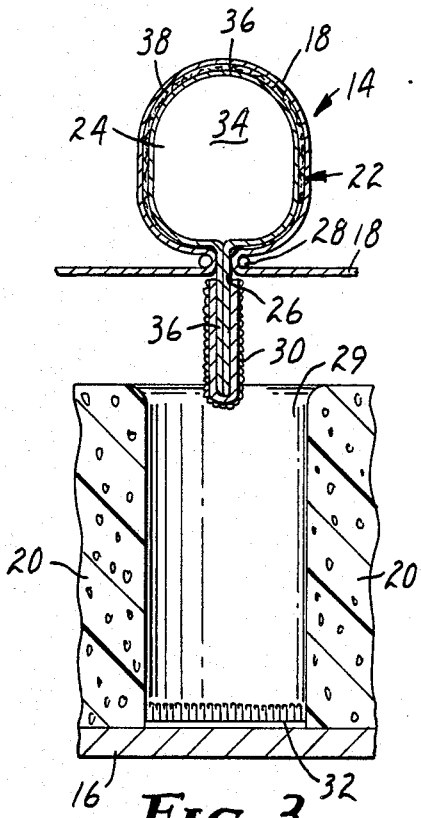
FIG. 3 is a side view of the button forming assembly shown in FIG. 2 being applied in accordance with a method according to the present invention to tuft an upholstered item, with only a sectional fragment of the upholstered item being shown.

FIGS. 2 through 4 illustrate a first embodiment of a button forming assembly 14 according to the present invention adapted for use in forming button tufts on an upholstered cushion (such as a cushion of the chair 10) which cushion comprises (with reference to FIGS. 3 and 4) a backing 16 (e.g., a board or layer of strong nonwoven or woven fabric such as the woven fabric commercially designated "Dymetrol" TM sold by E.I. DuPont DeNemours and Company, Wilmington, Del.), a flexible cover 18 (e.g., leather or decorative fabric) overlying the backing 16, and a layer of compressible padding material 20 (e.g., resilient polymeric foam) between the backing 16 and the cover 18. As is seen in FIGS. 2 through 4, the button forming assembly 14 comprises a button forming member 22 including a head portion 24 in the shape of a button to be formed (generally spherical as shown), and an attachment portion 26 having a cross sectional area smaller than the cross sectioned area of the head portion 24 projecting from one side of the head portion 24. The button forming assembly 14 is adapted to have a part of the cover 18 smoothly positioned around the head portion 24 and gathered around the attachment portion 26 (FIG. 3), and the button forming member 22 includes securing means, illustrated as a metal ring 28, for securing that gathered part of the cover 18 around the attachment portion 26. Also provided is attachment means adapted for engagement between the attachment portion 26 and the backing 16 through an opening 29 in the padding material 20 to retain the button forming member 22 in place relative to the backing 16 and padding material (FIG. 4) with the cover 18 under tension and the padding 20 slightly compressed to shape it. As illustrated the attachment means is a fastener comprising a first fastener portion 30 including a plurality of loops forming most of the attachment portion 26, and a second fastener portion 32 including a plurality of barbed hooks adapted for engagement with the loops, which second fastener portion 32 is attached to the backing 16. Preferably the second fastener portion 32 with the barbed hooks is the hooked portion of the product sold under the trade designation SJ3446 "Latchlok" TM by Minnesota Mining and Manufacturing Company, St. Paul, Minn., which is made in accordance with the teaching of U.S. Pat. No. 4,454,183, (the disclosure of which is incorporated herein by reference), with the hooks being of sufficient size that the loops must be broken to afford separation of the loops from the hooks after the fastener portions 30 and 32 are engaged by pressing them together.

As is best seen in FIG. 2, the head portion 24 of the button forming member 22 illustrated includes a generally cylindrical piece 34 of foam (which piece 34 may be removed from the padding 20 to form the opening 29 in which the fastener portions 30 and 32 engage) with a length of strong muslin fabric 36 wrapped lengthwise around the piece 34 of foam and having its ends joined (as by sewing) to the ends of the first fastener portion 30. The first fastener portion 30 can be a generally U-shaped length of the looped portion of the product sold under the trade designation SJ3446 "Latchlok" TM by Minnesota Mining and Manufacturing Company, St. Paul, Minn. Also, the head portion 24 can include a layer 38 of fibrous material (e.g., dacron fill) around its periphery which helps smooth its periphery when it is covered.

The method according to the present invention for forming button tufts in upholstered cushions, such as those on the chair 10, using the button forming assembly 14 is illustrated in FIGS. 3 and 4. First, as seen in FIG. 3, the part of the cover 18 is positioned smoothly around the head portion 24 and gathered around the attachment portion 26 and is then secured around the attachment portion 26 by contracting the metal ring 28 around it.

Next, the attachment portion 26 and the backing 16 are attached together through the opening 29 in the padding 20 by pressing the button forming member 22 and the attached part of the cover 18 into the opening 29 so that the fastener portions 30 and 32 contact and permanently engage. Then, as shown in FIG. 4, the cover 18 will be tensioned to compress and shape the padding 20 around the opening 29, and the button tuft formed by the head portion 24 of the button forming member 22 with the part of the cover 18 fastened around it will be visible from the outer surface of the cover 18.

Figure 5:
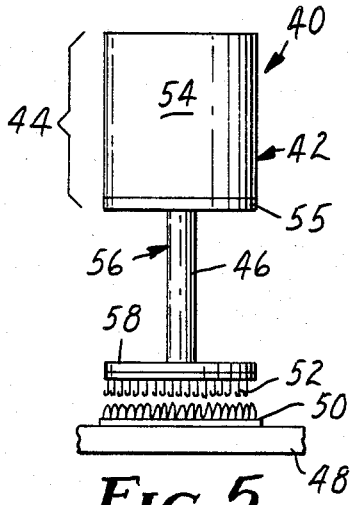
FIG. 5 is a side view of a second embodiment of a button forming assembly according to the present invention illustrated with a fragment of a backing layer.

Referring now to FIG. 5 there is illustrated a second embodiment of a button forming assembly 40 according to the present invention adapted for use in forming button tufts on upholstered cushions such as those of the chair 10. As is seen in FIG. 5, the button forming assembly 40 comprises a button forming member 42 including a head portion 44 in the shape of a button to be formed (generally spherical as shown), and an attachment portion 46 having a cross sectional area smaller than the cross sectioned area of the head portion 44 projecting from one side of the head portion 44. The button forming assembly 40 is adapted to have a part of a cover (not shown) smoothly positioned around the head portion 44 and gathered around the attachment portion 46, and the button forming member 42 includes securing means, such as a metal ring or cord (not shown) for securing that gathered part of the cover around the attachment portion 46. Also provided is attachment means adapted for engagement between the attachment portion 46 and a backing 48 through an opening in compressible padding material to retain the button forming member 42 in place relative to the backing 48 and padding material with the cover under tension and the padding slightly compressed to shape the cushion, in the same manner that the button forming member 22 illustrated in FIGS. 2 through 4 is used.

As illustrated the attachment means is a fastener comprising a first fastener portion 50 including a plurality of loops fixed to the backing 48, and a second fastener portion 52 including a plurality of barbed hooks adapted for engagement with the loops attached to the attachment portion 26. Preferably the second fastener portion 52 with the barbed hooks is also made in accordance with the teaching of U.S. Pat. No. 4,454,183 so that the loops must be broken to afford separation of the loops from the hooks after the fastener portions 50 and 52 are engaged by pressing them together.

As is seen in FIG. 5, the head portion 44 of the button forming member 42 includes a generally cylindrical piece 54 of foam and a circular disk-like end 55 of a hard polymeric spool 56. The spool 56 includes a central cylindrical part concentric with and of a diameter significantly smaller than the diameter of the end 55, which central part defines the attachment portion 46. The spool 56 also includes a circular disk-like end 58 on the end of the attachment portion 46 opposite its end 55 and has the second fastener portion 52 fixed on the outer surface of the end 58.

The method according to the present invention for forming button tufts in upholstered cushions using the button forming assembly 40 is similar to the method illustrated in FIGS. 3 and 4. First, part of the cover is positioned smoothly around the head portion 44 and gathered around the attachment portion 46 and is then secured around the attachment portion 46 as by contracting a metal ring or tying a cord around it.

Next, the attachment portion 46 and the backing 48 are attached together through an opening in the padding by pressing the button forming member 42 and the attached part of the cover into the opening so that the fastener portions 50 and 52 contact and permanently engage. Such contact is easily made because of the rigid nature of the spool 56. Then the cover will be tensioned to compress the padding around the opening, and the button tuft formed by the head portion of the button forming member 42 with the part of the cover fastened around it will be visible from the outer surface of the cover.

Figure 6:
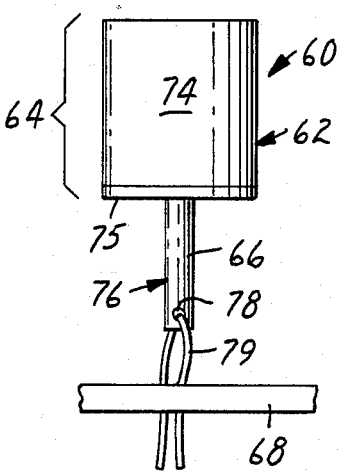
FIG. 6 is a side view of a third embodiment of a button forming assembly according to the present invention illustrated with a fragment of a backing layer.

Referring now to FIG. 6 there is illustrated a third embodiment of a button forming assembly 60 according to the present invention adapted for use in forming button tufts on upholstered cushions such as those of the chair 10. As is seen in FIG. 6, the button forming assembly 60 comprises a button forming member 62 including a head portion 64 in the shape of a button to be formed (generally spherical as shown), and an attachment portion 66 having a cross sectional area smaller than the cross sectioned area of the head portion 64 projecting from one side of the head portion 64. The button forming assembly 60 is adapted to have a part of a cover (not shown) smoothly positioned around the head portion 64 and gathered around the attachment portion 66, and the button forming member 62 includes securing means, illustrated as a metal ring (not shown) for securing that gathered part of the cover around the attachment portion 66. Also provided is attachment means adapted for engagement between the attachment portion 66 and a backing 68 through an opening in compressible padding material to retain the button forming member 62 in place relative to the backing 68 and padding material with the cover under tension and the padding slightly compressed to shape the cushion, in the same manner that the button forming member 22 illustrated in FIGS. 2 through 4 is used.

As is seen in FIG. 6, the head portion 64 of the button forming member 62 includes a generally cylindrical piece 74 of foam and a circular disk-like end 75 of a hard polymeric structure 76 which includes a cylindrical part concentric with and of a diameter significantly smaller than the diameter of the end 75 defining the attachment portion 66. The attachment portion 66 has a transverse through opening 78 at its end opposite the end 75 through which a cord 79 is threaded that provides the attachment means for the button forming assembly 60.

The method according to the present invention for forming button tufts in upholstered cushions, using the button forming assembly 60 is similar to the method illustrated in FIGS. 3 and 4. First, part of the cover is positioned smoothly around the head portion 64 and gathered around the attachment portion 66 and is then secured around the attachment portion 66 as by contracting a metal ring or tying a cord around it.

Next, the attachment portion 66 and the backing 68 are attached together through an opening in the padding by tying the cord 79 into the backing 68. Then the cover will be tensioned to compress the padding around the opening, and the button tuft formed by the head portion 64 of the button forming member 62 with the part of the cover attached around it will be visible from the outer surface of the cover.

Figure 7:
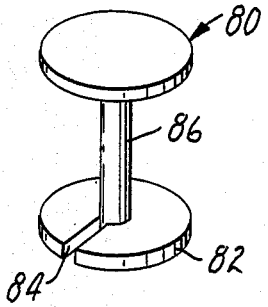
FIG. 7 is a perspective view of part of a fourth alternate embodiment of a button forming assembly according to the present invention.
Figure 8:
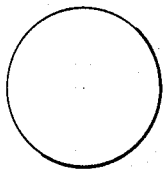
FIGS. 8 through 15 shown alternate shapes of button tufts that can be made using the button forming assembly according to the present invention.
Figure 11:
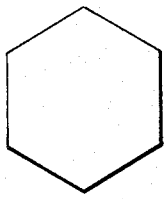
Figure 14:
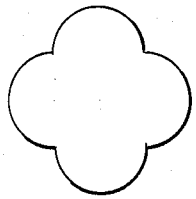
Figure 9:
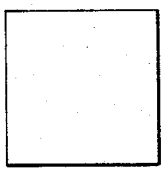
Figure 12:
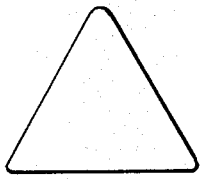
Figure 15:
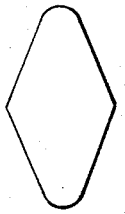
Figure 10:
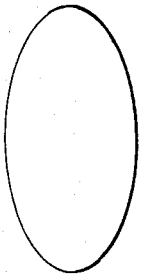

FIG. 7 illustrates a spool-like structure 80 that could be substituted for the spool 56 or the structure 76 in the button forming members 42 or 62 respectively. The structure differs from the spool 56 or structure 76 in that it has a circular end 82 with a radial slot 84 so that a cord providing attachment means can be tied around a central portion 86 of the spool 80 and passed through the slot 84 to secure the spool to a backing.

Figure 13:
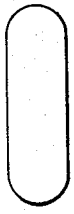

FIGS. 8 through 15 illustrate various shapes for button tufts that can be formed by changing the cross sectional shape of the head portion of the button forming member according to the present invention. These shapes include round (FIG. 8), square (FIG. 9), oval (FIG. 10), hexagonal (FIG. 11), triangular (FIG. 12) or elongate rectangular with radiused ends (FIG. 13). Also in the same way, a button tuft having semispherical projections around its periphery (FIG. 14) or that is generally diamond shaped (FIG. 15) can be formed. The shapes illustrated are illustrative only, as many additional shapes could be formed.

The present invention has now been described with reference to several embodiments thereof. It will be apparent to those skilled in the art that many changes can be made in the embodiments described without departing from the scope of the present invention. Thus the scope of the present invention should not be limited to the structures or methods described in this application, but only by the structures and methods described by the language of the claims and the equivalents thereof.

We claim:

1. An upholstered cuhion comprising a backing, a flexible cover overlying the backing, a layer of compressible padding material between the backing and the cover having a through opening, and a button forming assembly comprising:

a button forming member including a head portion having the shape of a button to be formed, a fabric loop having a first end part extending around said head portion, a central part providing an attachment portion having a cross sectional area smaller than the cross sectional area of said head portion projecting from one side of said head portion, and a second end part projecting past said central part away from said first part, said cover including a part positioned smoothly around said first end part and head portion and gathered around said attachment portion;

securing means securing said cover around said attachment portion for retaining said part of said cover around said head portion; and attachment means in engagement between said attachment portion and said backing through said opening in said padding material to retain said button forming member in place relative to said backing and compressible padding material with said cover under tension and said padding slightly compressed around said opening, said attachment means comprising a fastener including a first fastener portion having a plurality of loops, and a second fastener portion having a plurality of hooks including barbs engaged with said loops so that said loops engaged with said hooks must be broken to afford separation of said hooks from said loops, one of said fastener portions being attached to said backing, and the other of said fastener portions being attached to said second end part of said fabric loop.

2. An upholstered cushion according to claim 1 wherein said means for securing comprises a metal ring.

3. A button forming assembly adapted for use in an upholstered cushion of the type comprising a backing, a flexible cover overlying the backing, and a layer of compressible padding material between the backing and the cover, said button forming assembly comprising:

a button forming member including a head portion in the shape of a button to be formed, a fabric loop having a first end part extending around said head portion, a central part providing an attachment portion having a cross sectional area smaller than the cross sectional area of said head portion projecting from one side of said head portion, and a second end part projecting past said central part away from said first part;

securing means adapted for securing the cover around said attachment portion with a part of the cover positioned smoothly around said head portion: and attachment means adapted for engagement between said attachment portion and said backing through an opening in said padding material to retain said button forming member in place relative to said backing and padding material with the cover under tension and the padding partially compressed around the opening to shape the cushion, said attachment means comprising a fastener comprising a first fastener portion including a plurality of loops, and a second fastener portion including a plurality of hooks including barbs adapted for engagement with said loops so that said loops engaged with said hooks must be broken to afford separation of said hooks from said loops, one of said fastener portions being adapted to be attached to said backing, and the other of said fastener portions being attached to said second end part of said fabric loop.

4. A button forming assembly according to claim 3 wherein said means for securing comprises a metal ring.

5. A button forming assembly according to claim 3 wherein said head portion is generally circular or spherical in shape.

6. A button forming assembly according to claim 3 wherein said head portion is generally rectangular in shape.

7. A button forming assembly according to claim 3 wherein said head portion is generally triangular in shape.

8. A button forming assembly according to claim 3 wherein said head portion is generally oval in shape.

9. A button forming assembly according to claim 3 herein said head portion is generally hexagonal in shape.

10. A button forming assembly according to claim 3 wherein said head portion has a plurality of projecting semispherical lobes around its periphery.

11. A button forming assembly according to claim 3 wherein said head portion has generally the shape of a diamond.

* * * * *